US008532326B2

(12) United States Patent
Liao

(10) Patent No.: US 8,532,326 B2
(45) Date of Patent: Sep. 10, 2013

(54) FASTENER STRUCTURE AND REVERSED SOUNDING STRUCTURE USING THE SAME

(75) Inventor: Chien-Chung Liao, Taipei (TW)

(73) Assignee: Inventec Corporation (TW)

( * ) Notice: Subject to any disclaimer, the term of this patent is extended or adjusted under 35 U.S.C. 154(b) by 172 days.

(21) Appl. No.: 13/243,356

(22) Filed: Sep. 23, 2011

(65) Prior Publication Data

US 2012/0275637 A1 Nov. 1, 2012

(30) Foreign Application Priority Data

Apr. 26, 2011 (TW) ..... 100114518 A

(51) Int. Cl.
*H04R 1/02* (2006.01)

(52) U.S. Cl.
USPC ..... 381/395; 381/386

(58) Field of Classification Search
USPC ..... 381/87, 332, 386, 395; 181/148, 181/198, 199
See application file for complete search history.

(56) References Cited

U.S. PATENT DOCUMENTS

| | | | | |
|---|---|---|---|---|
| 7,130,436 | B1 * | 10/2006 | Tabata et al. | 381/190 |
| 7,657,053 | B2 * | 2/2010 | Kosuda | 381/395 |
| 2001/0033672 | A1 * | 10/2001 | Ohta | 381/386 |
| 2011/0235846 | A1 * | 9/2011 | Jiang et al. | 381/386 |

FOREIGN PATENT DOCUMENTS

| | | |
|---|---|---|
| TW | M241926 | 8/2004 |
| TW | M248176 | 10/2004 |
| TW | M256040 | 1/2005 |

* cited by examiner

*Primary Examiner* — Tuan D Nguyen
(74) *Attorney, Agent, or Firm* — Lowe Hauptman & Ham, LLP

(57) ABSTRACT

A fastener structure is for retaining a speaker unit on a sound tank housing. The fastener structure includes a spring piece and an elastic protrusion rib. The spring piece includes a board, a first bending portion and a second bending portion. The board located within a through hole of the sound tank housing. The first bending portion located at one end of the board is for retaining the speaker unit on a second side of the sound tank housing. The second bending portion located at the other end of the board is exposed over a first side of the sound tank housing and used as an elastic contact. The elastic protrusion rib is disposed within the through hole, and is protruded from one side of the board to lean against between the board and the through hole, so that the board is wedged within the through hole.

20 Claims, 7 Drawing Sheets

200

FASTENER STRUCTURE AND REVERSED SOUNDING STRUCTURE USING THE SAME

This application claims the benefit of Taiwan application Serial No. 100114518, filed Apr. 26, 2011, the subject matter of which is incorporated herein by reference.

BACKGROUND OF THE INVENTION

1. Field of the Invention

The invention relates in general to a fastener structure, and more particularly to a fastener structure and a reversed sounding structure using the same.

2. Description of the Related Art

Referring to FIG. 1, a cross-sectional view of a conventional sound tank structure is shown. In the conventional sound tank structure 100, the speaker unit 120 normally contacts the circuit board 130 through an electrode 122 disposed at the bottom or by way of soldering the circuit board 130 through a wire. Due to the restriction in the height, if the bottom of the speaker unit 120 is directly disposed on the circuit board 130, the venting side must face upwards and cannot face the vent (not illustrated). Consequently, the position of the vent of the sound tank housing 110 is not conformed to the design requirements. Moreover, if the bottom of the speaker unit 120 faces upwards, there will be no electrical conduction between the bottom of the electrode 122 and the circuit board 130.

According to the prior method for resolving the problem of electrical conduction, a wire is soldered on the bottom electrode of the speaker unit, and then the speaker unit is electrically connected to the circuit board through a connector or by way of soldering. However, the prior method which requires high assembly cost and involves complicated procedures is not suitable for mass production.

SUMMARY OF THE INVENTION

The invention is directed to a reversed sounding structure and a fastener structure using the same for resolving the problem of electrical conduction to facilitate assembly and save cost.

According to a first aspect of the present invention, a fastener structure for retaining a speaker unit on a sound tank housing is provided. The fastener structure includes a spring piece and an elastic protrusion rib. The spring piece includes a board, a first bending portion and a second bending portion. The board located within a through hole of the sound tank housing. The first bending portion located at one end of the board is for retaining the speaker unit on a second side of the sound tank housing. The second bending portion located at the other end of the board is exposed over a first side of the sound tank housing and used as an elastic contact. The elastic protrusion rib is disposed within the through hole, and is protruded from one side of the board to lean against between the board and the through hole, so that the board is wedged within the through hole.

According to a second aspect of the present invention, a reversed sounding structure including a sound tank housing, a speaker unit and a fastener is provided. The sound tank housing has a front sound tank disposed on a first side of the sound tank housing. The speaker unit includes an electrode and a speaker, wherein the electrode is located on a bottom surface of the speaker, and a venting side of the speaker is located on the sound tank housing for emitting a vibration sound to the front sound tank. The fastener is for fixing the speaker unit on a second side of the sound tank housing, and one end of the fastener is elastically retained on the bottom surface of the speaker, and is electrically connected to the electrode.

The above and other aspects of the invention will become better understood with regard to the following detailed description of the preferred but non-limiting embodiment(s). The following description is made with reference to the accompanying drawings.

DETAILED DESCRIPTION OF THE INVENTION

In the reversed sounding structure and the fastener structure of the present embodiment, a speaker unit and a sound tank housing are reversed on a circuit board, so that the bottom electrode faces upwards, and the venting side of the speaker faces downwards. The reversed speaker unit can be fixed on one side of the sound tank housing through a set of fasteners, and one end of each fastener is elastically retained on the bottom surface of the speaker and electrically connected to the electrode on the bottom surface. The reversed sounding structure of the present embodiment has a miniaturized volume, so that the space utilization rate is increased, the position of the vent of the front sound tank is conformed to the appearance requirements and the appearance design with a lateral vent is thus achieved.

Figure 1:
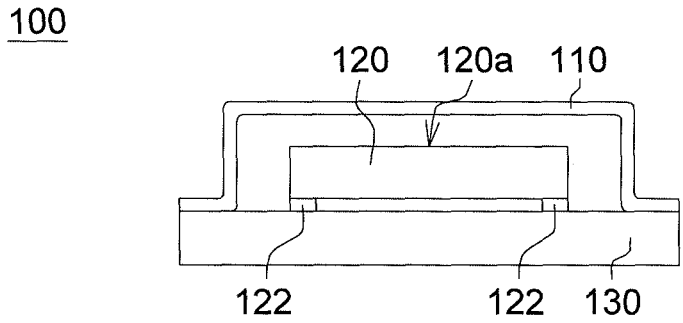
FIG. 1 (Prior Art)
FIG. 1 shows a cross-sectional view of a generally known sound tank structure.
Figure 2A:
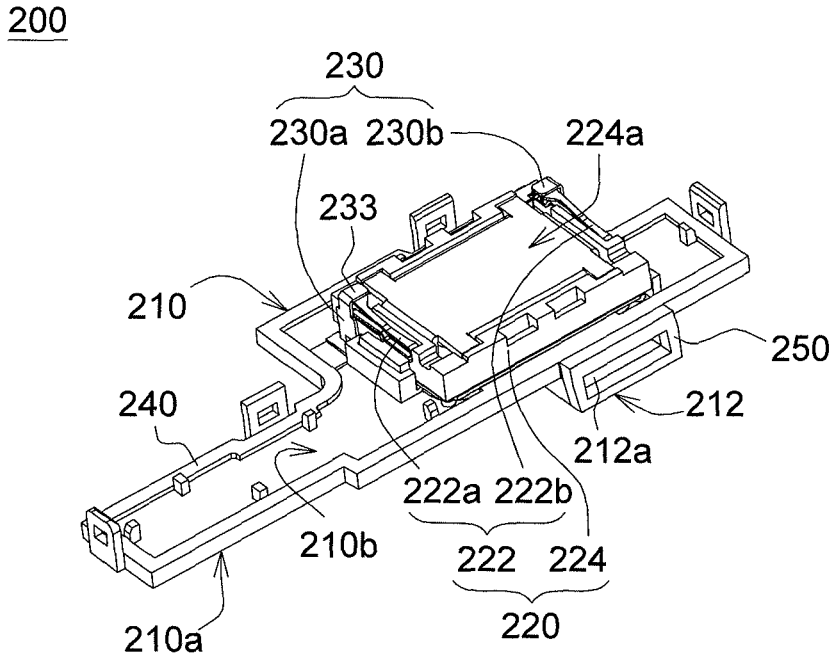
FIGS. 2A and 2B respectively show an assembly diagram and a decomposition diagram of a reversed sounding structure according to an embodiment of the invention.
Figure 2B:
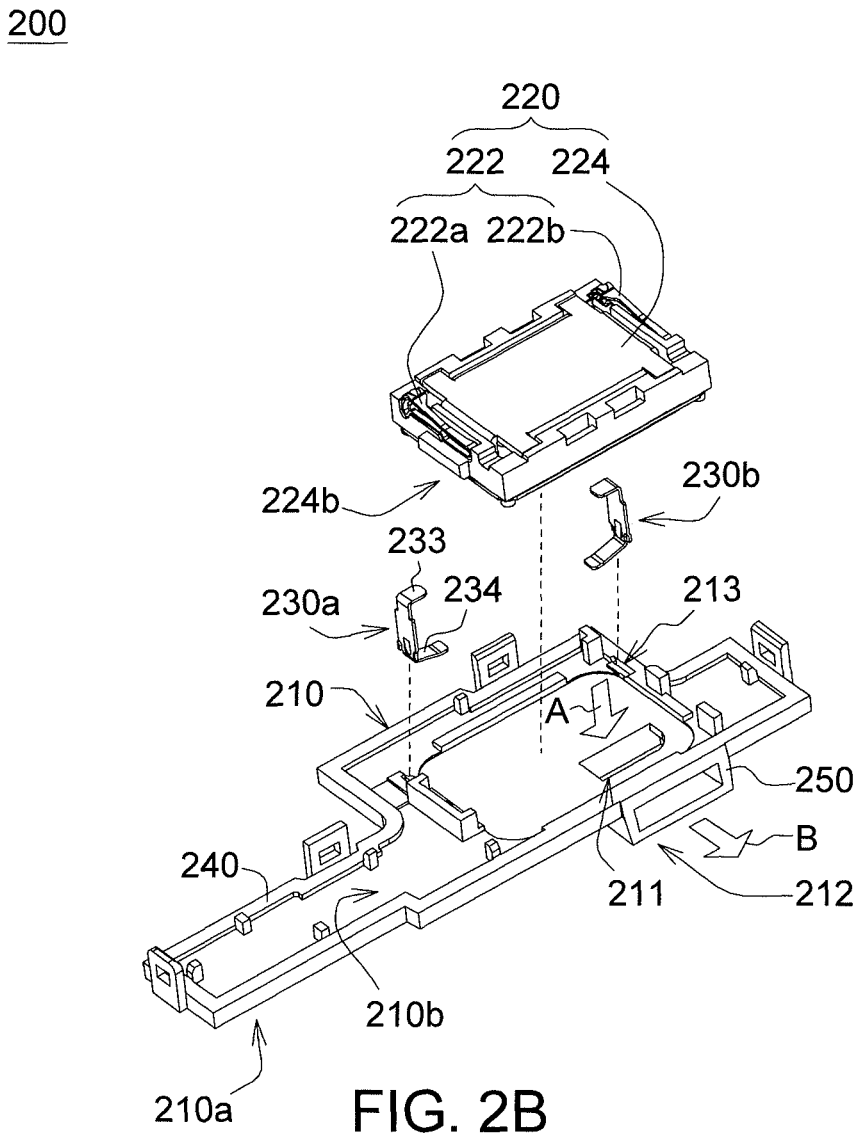
Figure 3:
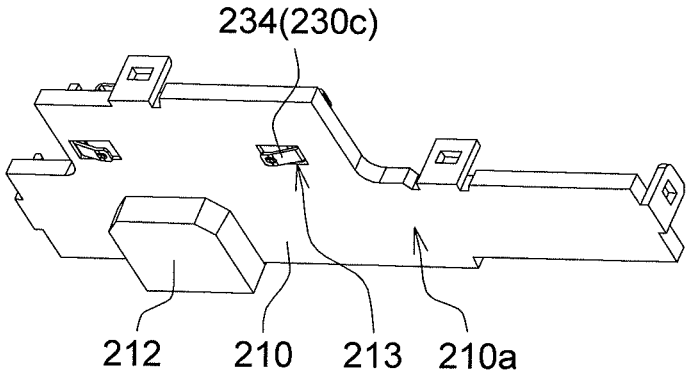
FIG. 3 shows a bottom view of a reversed sounding structure according to an embodiment of the invention.

FIGS. 2A and 2B respectively show an assembly diagram and a decomposition diagram of a reversed sounding structure according to an embodiment of the invention. FIG. 3 shows a bottom view of a reversed sounding structure according to an embodiment of the invention.

As indicated in FIGS. 2A and 2B, the reversed sounding structure 200 includes a sound tank housing 210, a speaker unit 220 and a fastener 230. The sound tank housing 210 has a front sound tank 212 located on a first side 210*a* of the sound tank housing 210. The speaker unit 220 includes an electrode 222 and a speaker 224. The electrode 222 is located on a bottom surface 224*a* of the speaker 224, and a venting side 224*b* of the speaker 224 is disposed on the sound tank housing 210 for emitting a vibration sound to the front sound tank 212. The fastener 230 is for fixing the speaker unit 220 on a second side 210*b* of the sound tank housing 210, wherein one end of the fastener 230 is elastically retained on the bottom surface 224*a* of the speaker 224 and is electrically connected to the electrode 222.

As indicated in FIGS. 2A and 2B, the electrode 222 of the speaker unit 220 faces upwards, and the venting side 224*b* of the speaker 224 faces downwards, so that the vibration sound outputted by the speaker 224 is emitted via a lateral vent 212*a* of the front sound tank 212. Thus, the position of the vent side 224*b* is conformed to the appearance requirements of the lateral vent 212*a*.

In addition, the electrode 222 of the speaker unit 220 includes as anode spring piece 222*a* and a cathode spring piece 222*b*. The anode spring piece 222*a* is located on one side of the speaker 224. The cathode spring piece 222*b* is located on the other side of the speaker 224. The anode spring piece 222*a* and the cathode spring piece 222*b* are electrically connected to the anode and the cathode of the speaker 224 respectively for inputting a working voltage. Thus, when the working voltage is inputted, the thin film inside the speaker 224 is vibrated for emitting a vibration sound. Also, there can be two fasteners 230, namely, the first fastener 230*a* and the second fastener 230*b*. The first fastener 230*a* is located on one side of the speaker 224 and is bent towards the bottom surface 224*a* of the speaker 224 to form a bending portion for retaining the anode spring piece 222*a*. The second fastener 230*b* is located on the other side of the speaker 224 and is bent towards the bottom surface 224*a* of the speaker 224 to form a bending portion for retaining the cathode spring piece 222*b*. Thus, the first fastener 230*a* and the second fastener 230*b* are elastically retained on the bottom surface 224*a* of speaker 224 and are electrically connected to the anode spring piece 222*a* and the cathode spring piece 222*b* respectively.

In an embodiment, the reversed sounding structure 200 further includes a first sealing material 240 made from a sponge or other porous materials. The first sealing material, such as a bar-shaped sponge, is attached in a manner surrounding the sound tank housing 210 and used as a noise wall. Besides, the reversed sounding structure further includes a second sealing material 250 made from a sponge or other porous materials. The second sealing material 250I, such as a bar-shaped sponge, is attached in a manner surrounding the lateral vent 212*a* of the front sound tank 212 and used as the other noise wall.

As indicated in FIG. 3, the front sound tank 212 is such as a U-shaped cover with a lateral vent 212*a*. The bottom of the U-shaped cover is fixed on the first side 210*a* of the sound tank housing 210, so that the lateral vent 212*a* faces a venting direction (indicated by the arrow B of FIG. 2B) of the sound tank housing 210. As indicated in FIG. 2B, the sound tank housing 210 has an exit 211 near the bottom of the front sound tank 212 via which the vibration sound is emitted to. Thus, when the venting side 224*b* of the speaker 224 emits a vibration sound, the sound wave is transmitted forwards to the front sound tank 212 via the exit 211 in a direction as indicated by the arrow A of FIG. 2B. After the sound wave is reflected by the front sound tank 212 and resonation is generated, the sound wave is transmitted outwards via the lateral vent 212*a* in a direction as indicated by the arrow B of FIG. 2B.

As indicated in FIG. 2B and 3, the sound tank housing 210 has a through hole 213 which penetrates to the second side 210*b* from the first side 210*a*. The fastener 230 is disposed within the through hole 213, and the other end is exposed over the first side 210*a* of the sound tank housing 210 and used as an elastic contact 230*c*.

Figure 4:
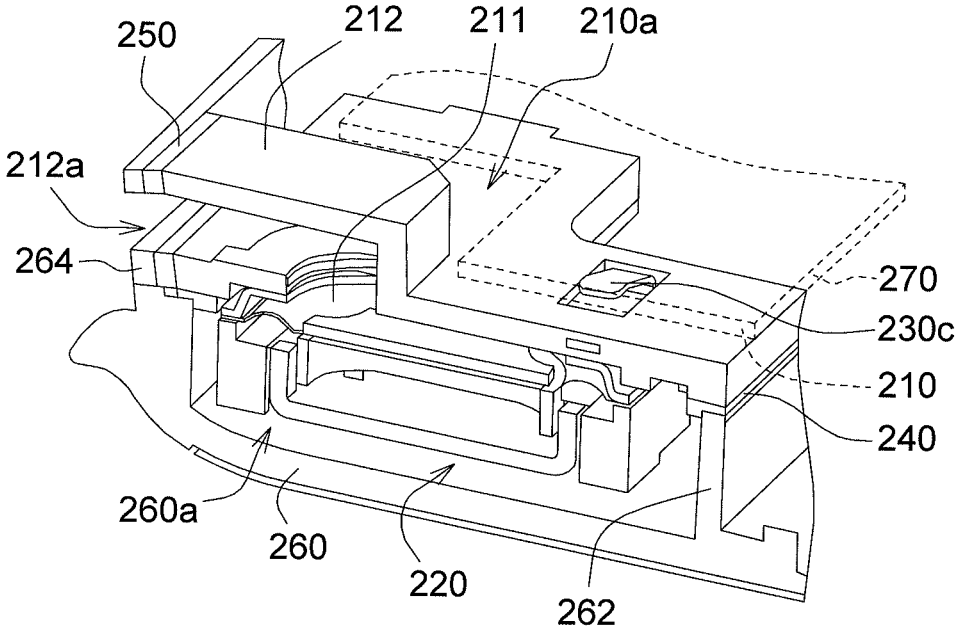
FIG. 4 shows a cross-sectional view of a reversed sounding structure.
Figure 5A:
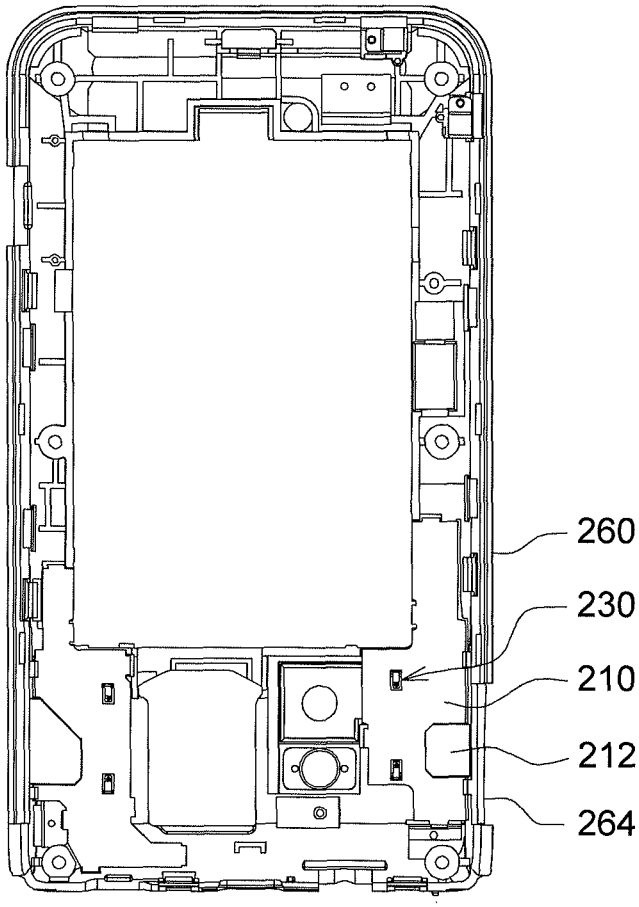
FIGS. 5A and 5B respectively show a layout diagram and a side exploration diagram of a reversed sounding structure according to an embodiment of the invention.
Figure 5B:
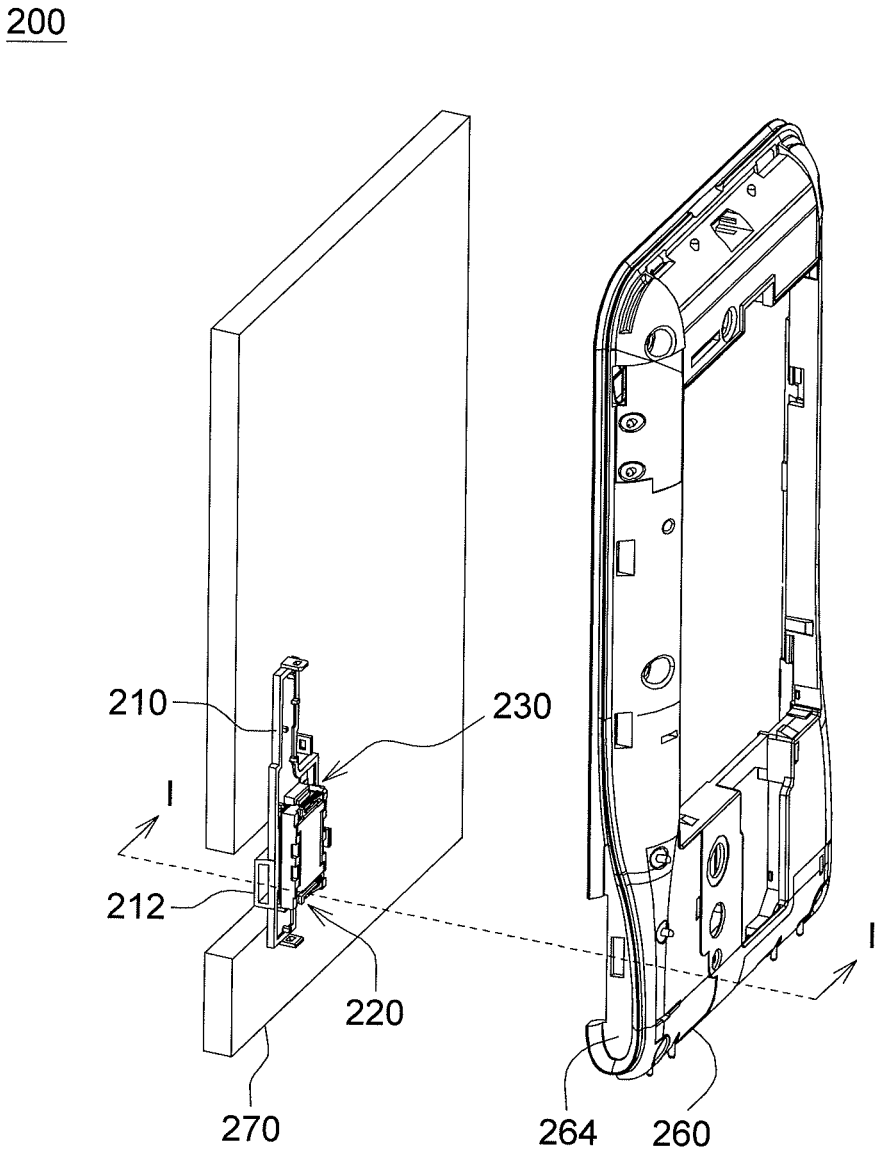

FIG. 4 shows a cross-sectional view of a reversed sounding structure. FIGS. 5A and 5B respectively show a layout diagram and a side exploration diagram of a reversed sounding structure according to an embodiment of the invention.

As indicated in FIG. 4, the reversed sounding structure 200 further includes an outer casing 260 which has a divider 262 inside. The divider 262 is jointed to the surrounding of the sound tank housing 210, so that a chamber 260*a* is formed between the outer casing 260 and the sound tank housing 210. In an embodiment, the size of the chamber 260*a* is larger than that of the speaker unit 220 so that the speaker unit 220 can be received in the chamber 260*a*. In FIG. 4, the chamber 260*a* is located at the rear of the speaker unit 220, so that the chamber 260*a* can be used as a rear sound tank of the speaker unit 220. When the venting side 224*b* of the speaker unit 220 emits a vibration sound, a part of the sound wave generates resonation within the rear sound tank and the characteristics of the sound wave are changed accordingly. Based on the resonation between the front and the rear sound tanks, the speaker unit 220 adjusts the tone quality accordingly.

In FIG. 4, the sound tank housing 210 covers the top surface of the divider 262, and the first sealing material 240 is sealed between the divider 262 and the sound tank housing 210 and used as a noise wall. In addition, the front sound tank 212 is engaged with an acoustical board 264 of the outer casing 260, and the second sealing material 250 is sealed between the front sound tank 212 and the acoustical board 264 and used as the other noise wall. Thus, the sound wave vibrating within the front and the rear sound tanks is isolated from the exterior so that the resonation is enhanced and the vibration sound is transmitted to the exterior of the outer casing 260 via the lateral vent 212*a*.

The reversed sounding structure 200 further includes a circuit board 270 disposed on the first side 210*a* of the sound tank housing 210, so that the reversed speaker unit 220 and the sound tank housing 210 are enclosed between the outer casing 260 and the circuit board 270, and the reversed speaker unit 220 can be electrically connected to the circuit board 270 via the fastener 230. The fastener 230 is for transmitting the signal inputted by the circuit board 270 to the speaker unit 220 for driving the speaker 224 to emit a vibration sound.

Figure 6:
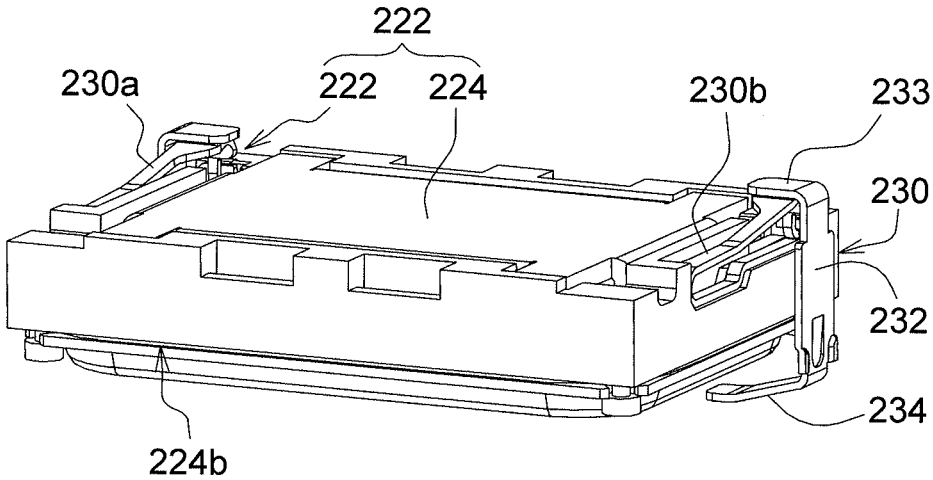
FIGS. 6 and 7 respectively show a 3D schematic diagram of a fastener structure according to an embodiment of the invention.
Figure 7:
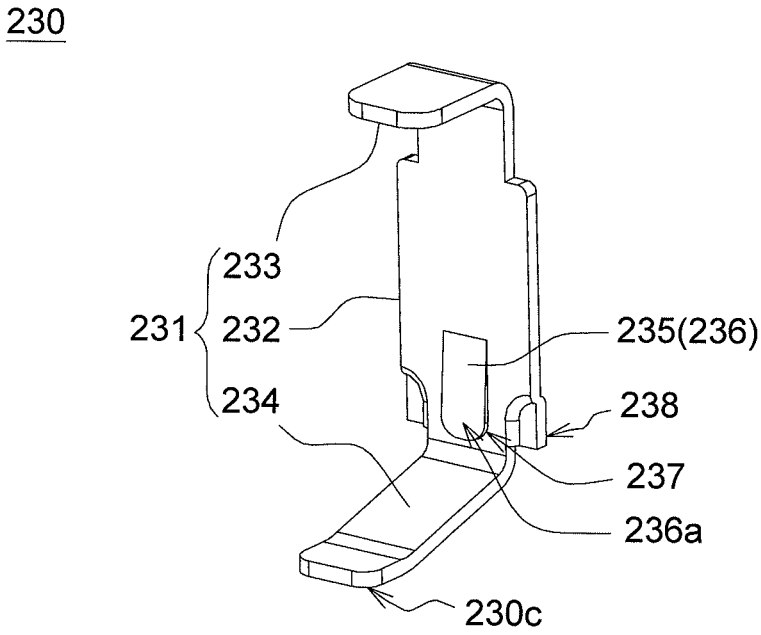
Figure 8:
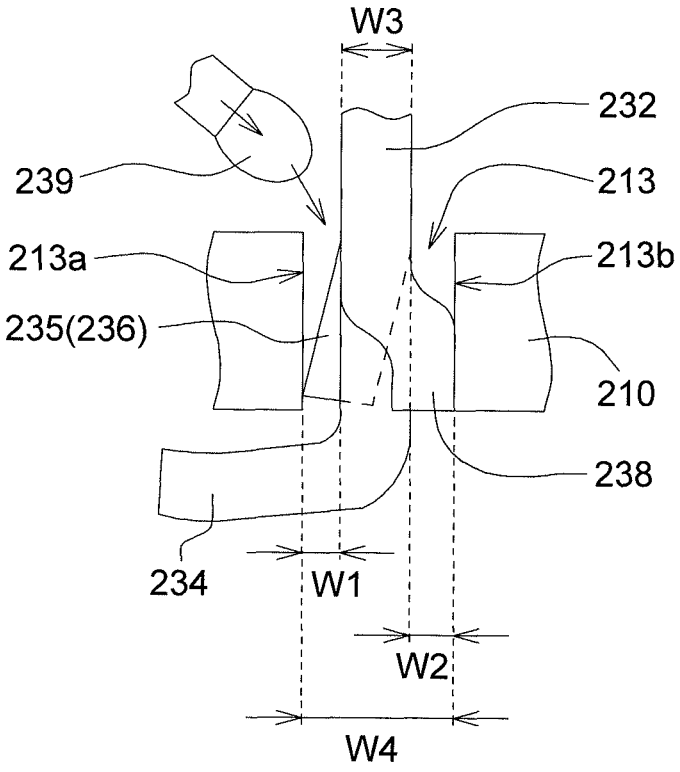
FIG. 8 shows a cross-sectional view of a fastener structure disposed within a through hole according to an embodiment of the invention.

FIGS. 6 and 7 respectively show a 3D schematic diagram of a fastener structure according to an embodiment of the invention. FIG. 8 shows a cross-sectional view of a fastener structure disposed within a through hole according to an embodiment of the invention. To elaborate the fastener 230 wedged within the through hole 213 in greater details, the details structures of the fastener 230 are illustrated in FIGS. 6 and 7 but the through hole 213 of the sound tank housing 210 is not illustrated. As indicated in FIGS. 6, 7 and 8, the fastener 230 includes a spring piece 231 and an elastic protrusion rib 235. The spring piece 231 includes a board 232, a first bending portion 233 and a second bending portion 234. The board 232 is located within a through hole 213 of the sound tank housing 210 as indicated in FIG. 8. The first bending portion 233 is located at one end of the board 232 for retaining the speaker unit 220 on one side (that is, the second side 210*b*) of the sound tank housing 210 as indicated in FIG. 2A. The second bending portion 234 is located at the other end of the board 232 and is exposed over the opposite side (that is, the first side 210*a*) of the sound tank housing 210 and used as an elastic contact 230*c* as indicated in FIG. 3. The elastic protrusion rib 235 is disposed within the through hole 213, wherein the elastic protrusion rib 235 leans against between the board 232 and the through hole 213, so that the board 232 is wedged within the through hole 213.

In an embodiment, the first bending portion 233 and the second bending portion 234, such as L-shaped bending portions, integrally form a U-shaped structure with the board 232, so that the spring piece 231 has the functions of elastic retaining and electrical conduction. In addition, a colloid 239, such as a thermosetting colloid, can be interposed into the through hole 213 of the sound tank housing 210, so that the board 232 of the spring piece 231 can be fixed within the through hole 213 through the colloid 239 dispensed within the through hole 213.

The elastic protrusion rib 235 can be a deformable metal piece protruded from one side of the board 232. As indicated in FIG. 7, the elastic protrusion rib 235 can be integrally formed in a recess 237 of the board 232 as a tongue 236 by way of stamping. The terminal end of the tongue 236 is not truncated but is fixed on the board 232, so that the front end 236*a* of the tongue 236 can be protruded outwards. In the present embodiment, the tongue 236 is elastically bent so that the front end 236*a* is obliquely protruded from the recess 237 for at least a thickness W1. When the tongue 236 is disposed within the through hole 213, the front end 236*a* of the tongue 236 is squeezed and dented into the recess 237, and the generated deformation is about the same with the displacement of the front end 236*a* of the tongue 236. In the present embodiment, the board 232 is wedged within the through hole 213 through the deformation of the elastic protrusion rib 235. Thus, the first bending portion 233 located at one end of the board 232 as indicated in FIG. 2A retains the speaker unit 220 on one side (that is, the first side 210*a*) of the sound tank housing 210, and the second bending portion 234 located at the other end of the board 232 is exposed over an opposite side (that is, the second side 210*b*) of the sound tank housing 210 and used as an elastic contact 230*c*. The elastic contact 230*c* is electrically connected to the circuit board 270 (referring to FIG. 4), so that the spring piece 231 is electrically connected between the circuit board 270 and the speaker unit 220 for transmitting the signal inputted by the circuit board 270 to the speaker unit 220 for driving the speaker 224 to emit a vibration sound.

As indicated in FIGS. 7 and 8, the board 232 has at least a dented portion 238 disposed within the through hole 213, wherein the dented portion 238 is protruded towards the other side of the board 232 for a thickness W2, so that the dented portion 238 leans against between the board 232 and the through hole 213. In an embodiment, there are two dented portions 238 integrally formed a bottom of the board 232 by way of stamping. The total thickness of the bottom of the processed board 232 and the dented portion 238 being W2+W3 is larger than the original thickness of the board 232 being W3. The thickness of the lower part of the board 232 is increased but the thickness of the upper part of the board 232 remains unchanged, so that the upper part of the board 232 can pass through the through hole 213 and the lower part of the board 232 is wedged within the through hole 213.

In an embodiment, the elastic protrusion rib 235 leans against the first hole wall 213*a* of the through hole 213, and the dented portion 238 leans against the second hole wall 213*b* of the through hole 213. The distance between the first hole wall 213*a* and the second hole wall 213*b* is the aperture W4 of the through hole 213. As indicated in FIG. 8, when a tolerance gap (loose matching) exists between the through hole 213 and the lower part of the board 232, that is, when the aperture of the through hole 213 is larger than the total thickness of the lower part of the board 232, W4>W2+W3, the elastic protrusion rib 235 will be protruded from one side of the board 232 for at least a thickness to compensate the tolerance gap. In other embodiments, when there is no tolerance gap between the through hole 213 and the lower part of the board 232 (tight matching), that is, when the aperture W4 of the through hole 213 is about the same with the total thickness of the lower part of the board 232, W4≈W2+W3, the elastic protrusion rib 235 will not be protruded from one side of the board 232 but will be dented into the recess 237 instead. Thus, regardless the matching between the through hole 213 and the board 232 is loose matching or tight matching, the tightness of matching can be adjusted through the deformation of the elastic protrusion rib 235 for wedging the board 232 within the through hole 213.

According to the reversed sounding structure and the fastener structure disclosed in the above embodiments, the speaker unit and the sound tank housing are reversed on the circuit board, so that the bottom electrode faces upwards and the venting side of the speaker faces downwards. Thus, the position of the vent of the front sound tank is conformed to the appearance requirements and the appearance design with a lateral vent is thus achieved. In addition, the reversed speaker unit can be fixed on one side of the sound tank housing through a set of fastener, and one end of each fastener is elastically retained on the bottom surface of the speaker and electrically connected to the bottom electrode. The fastener has elastic retaining function and can also be electrically connected between the speaker unit and the circuit board. In comparison to the prior solution for resolving the electrical conduction problem by way of soldering, the fastener of the present embodiment being a metal piece integrally formed in one piece can be wedged within the through hole as an element for electrical conduction without using additional soldering wire or connector. Therefore, the fastener of the present embodiment is easy to assemble, incurs low assembly cost and is suitable for mass production.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fastener structure for retaining a speaker unit on a sound tank housing, wherein the fastener structure comprises:

a spring piece, comprising:

a board located within a through hole of the sound tank housing;

a first bending portion located at one end of the board for retaining the speaker unit on a second side of the sound tank housing; and a second bending portion located at the other end of the board and exposed over a first side of the sound tank housing and used as an elastic contact; and an elastic protrusion rib disposed within the through hole and protruded from one side of the board, wherein the elastic protrusion rib leans against between the board and the through hole for wedging the board within the through hole.

2. The fastener structure according to claim 1, wherein the board, the first bending portion and the second bending portion are integrally formed as a U-shaped structure.

3. The fastener structure according to claim 1, further comprising a colloid interposed into the through hole for fixing the board in the through hole.

4. The fastener structure according to claim 1, wherein the speaker unit comprises an electrode and a speaker, the electrode is located on a bottom surface of the speaker, a venting side of the speaker is located on the sound tank housing for emitting a vibration sound, and the first bending portion is elastically retained on the bottom surface of the speaker and electrically connected to the electrode.

5. The fastener structure according to claim 1, wherein a circuit board is located on the first side of the sound tank housing and electrically connected to the elastic contact.

6. The fastener structure according to claim 5, wherein the spring piece is wedged within the through hole through the elastic protrusion rib and electrically connected between the circuit board and the speaker unit.

7. The fastener structure according to claim 1, wherein the elastic protrusion rib is integrally formed in a recess of the board by way of stamping.

8. The fastener structure according to claim 7, wherein the elastic protrusion rib is a tongue whose front end is obliquely protruded from the recess for at least a first thickness.

9. The fastener structure according to claim 1, wherein the board has at least a dented portion disposed within the through hole, and the dented portion is protruded towards the other side of the board for a second thickness.

10. The fastener structure according to claim 9, wherein the dented portion is integrally formed on the board by way of stamping.

11. A reversed sounding structure, comprising:

a sound tank housing having a front sound tank on a first side of the sound tank housing;

a speaker unit comprising an electrode and a speaker, wherein the electrode is located on a bottom surface of the speaker, and a venting side of the speaker is located on the sound tank housing for emitting a vibration sound to the front sound tank; and a fastener for fixing the speaker unit on a second side of the sound tank housing, wherein one end of the fastener is elastically retained on the bottom surface of the speaker and electrically connected to the electrode.

12. The reversed sounding structure according to claim 11, further comprising an outer casing, which has a divider inside, wherein the divider is jointed to the surrounding of the sound tank housing, so that a chamber is formed between the outer casing and the sound tank housing for receiving the speaker unit.

13. The reversed sounding structure according to claim 12, further comprising a first sealing material sealed between the divider and the sound tank housing as a first noise wall.

14. The reversed sounding structure according to claim 12, wherein the front sound tank has a lateral vent facing a venting direction of the sound tank housing.

15. The reversed sounding structure according to claim 14, further comprising a second sealing material disposed around the lateral vent, and the second sealing material is sealed between the outer casing and the front sound tank and used as a second noise wall.

16. The reversed sounding structure according to claim 11, wherein the electrode comprises an anode spring piece and a cathode spring piece, which are electrically connected to an anode and a cathode of the speaker respectively.

17. The reversed sounding structure according to claim 16, wherein the fastener comprises a first fastener and a second fastener, which are elastically retained on the bottom surface of the speaker and electrically connected to the anode spring piece and the cathode spring piece respectively.

18. The reversed sounding structure according to claim 11, wherein the sound tank housing has a through hole, the fastener is located within the through hole, and the other end of the fastener is exposed over the first side of the sound tank housing and used as an elastic contact.

19. The reversed sounding structure according to claim 18, further comprising a circuit board located on the first side of the sound tank housing, and the circuit board is electrically connected to the elastic contact.

20. The reversed sounding structure according to claim 19, wherein the sound tank housing is located between the circuit board and the speaker unit, and the fastener is wedged within the through hole and electrically connected between the circuit board and the speaker unit.

* * * * *